United States Patent [19]

Yoshino

[11] 4,301,933

[45] Nov. 24, 1981

[54] SYNTHETIC RESIN THIN-WALLED BOTTLE

[75] Inventor: Yataro Yoshino, Tokyo, Japan

[73] Assignee: Yoshino Kogyosho Co., Ltd., Tokyo, Japan

[21] Appl. No.: 101,172

[22] Filed: Dec. 7, 1979

[30] Foreign Application Priority Data

Jan. 10, 1979 [JP] Japan ..... 54-2804[U]

[51] Int. Cl.[3] ..... B65D 1/02

[52] U.S. Cl. ..... 215/1 C; 220/70

[58] Field of Search ..... 215/1 C; 220/70

[56] References Cited

U.S. PATENT DOCUMENTS

| | | | |
|---|---|---|---|
| 3,043,461 | 7/1962 | Glassco | 215/1 C |
| 3,598,270 | 8/1971 | Adomaitis et al. | 215/1 C |
| 3,727,783 | 4/1973 | Carmichael | 215/1 C |
| 3,871,541 | 3/1975 | Adomaitis | 215/1 C |
| 3,881,621 | 5/1975 | Adomaitis | 215/1 C |

*Primary Examiner*—Donald F. Norton

*Attorney, Agent, or Firm*—Stevens, Davis, Miller & Mosher

[57] ABSTRACT

The synthetic resin thin-walled bottle of this invention is raised up at its bottom to form a small-diameter rise having a conical lower portion and is also provided with a plurality of outwardly swelling bulges at the lower part of its body portion such that the underside of each bulge constitutes a ground-contacting portion. Thus, although a small-diameter rise having a conical lower portion is formed at the bottom, the standing position of the bottle is stabilized by provision of a large-diameter ground-contacting portion at the bottom.

3 Claims, 6 Drawing Figures

SYNTHETIC RESIN THIN-WALLED BOTTLE

FIELD OF THE INVENTION

This invention relates to a synthetic resin thin-walled bottle, more particularly to such bottle which is stabilized in its upright standing position.

PRIOR ART

Heretofore, glass bottles have been popularly used as container bottles of carbonated drinks, refrigerants and the like. However, such glass bottles, because of their weight, have the problems of high transportation cost and inconvenience in handling thereof.

In order to alleviate such problems, a light-weight thin-walled bottle has been devised which is blow-molded from a synthetic resin intermediate material. The body portion of such bottle is formed cylindrical while the bottom wall is bulged out spherically downwards. Thus, the blow-molded bottle is biaxially oriented and can maintain the excellent properties and durability of the synthetic resin, so the bottle, although thin-walled, has no strength problems.

However, since the bottom wall of the bottle is bulged out spherically downwards, it can not stay in its upright position unless a separately provided assisting leg element is used. Use of such an extra leg element results in increased manufacturing cost and unseemly external appearance of the bottle. Attempts have been made to form an integral protuberant leg element at the periphery of the bottle but, in this case, the underside of the leg portion might become unduly thin-walled and liable to break, and thus insufficient strength is provided at the bottom portion of the bottle.

In order to overcome such problems, this applicant tried to raise up the bottle bottom wall inwardly to form a concial inward rise while forming undulations at the peripheral portion of the bottom wall, or the ground-contacting portion of the bottle. In this case, although the bottle bottom portion is sufficiently strengthened owing to the rib-like function of the undulant peripheral portion, there still is involved a difficult problem. It is required for withstanding the internal pressure in the bottle to lessen the diameter of a basal portion adjacent the conical rise, which basal portion defines the inner diameter of the ground-contacting portion of the bottle, but if such basal portion is reduced in diameter, the stability of the bottle in its standing position is impaired and the bottle becomes prone to tip over particularly when the bottle is empty because the centroid thereof is positioned high. In other words, where said type of inward conical rise is formed at the bottle bottom, the annular protuberant portion defined by the basal portion becomes the ground-contacting portion of the bottle, so that if the diameter of such portion is small, the bottle becomes unstable when it is in its standing position. Therefore, when such bottles are carried on a conveyor for filling them with a liquid, it is found difficult to keep them standing stably on the conveyor throughout the bottling operation.

OBJECTS OF THE INVENTION

An object of this invention is to provide a large-diameter annular ground-contacting portion at the bottom of a synthetic resin bottle to allow stable standing of the bottle. Another object of this invention is to provide a bottle of this type which is so constructed that when the bottle is empty, the outer peripheral portion alone of the bottle bottom is brought into contact with the ground so as to be able to stand stably, and when the bottle is full, all the area of the bottom portion is brought into contact with the ground so that it can stand upright stably. Still another object of this invention is to provide a bottle of the type cited with a large-diameter annular ground-contacting portion at the bottom and also provide the inside thereof with a small-diameter rise having a conical lower portion with a stepped portion therebetween to provide a greater endurance against internal pressure of the bottle.

DETAILED DESCRIPTION OF THE INVENTION

Figure 2:
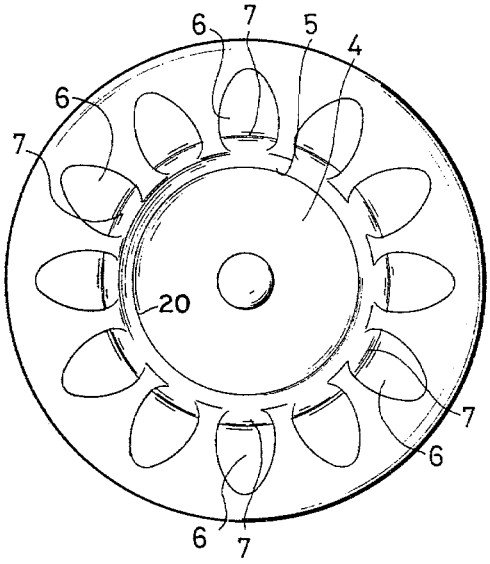
FIG. 2 is a bottom view of the same bottle.
Figure 1:
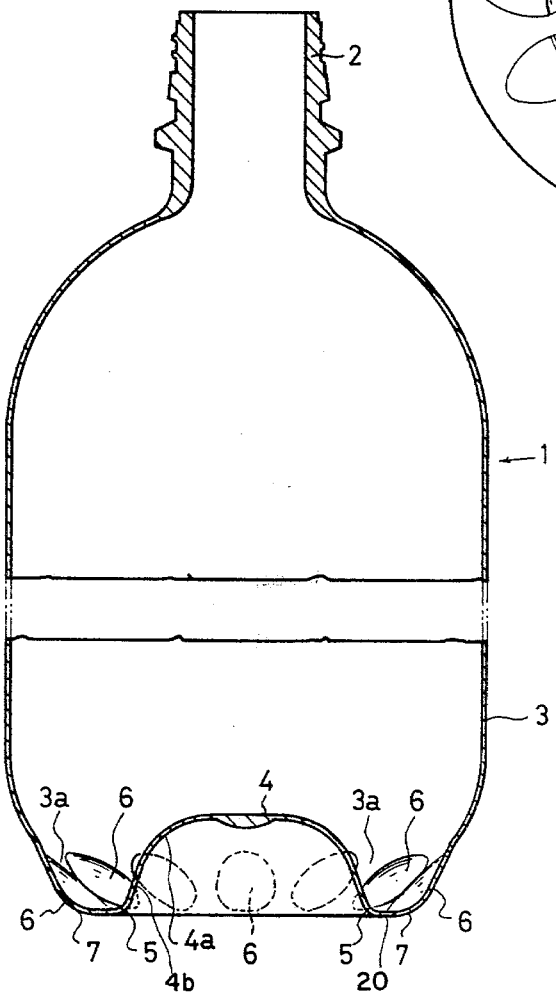
FIG. 1 is a sectional view, with parts broken away, of a synthetic resin thin-walled bottle in an embodiment of this invention.

Described first is a first embodiment of this invention with reference to FIGS. 1 and 2. The synthetic resin thin-walled bottle 1 of this invention is made by first forming a parison from a synthetic resin by injection molding and then biaxially orienting said parison by blow molding. As for the synthetic resin material used in this invention, a saturated polyester resin is found best suited, but other resins such as polypropylene and polyvinyl chloride are also usable. The neck portion 2 of the bottle 1 does not undergo biaxial orientation, that is, it remains as that of the parison. The body portion 3 and the bottom wall 4 are biaxially oriented to have a large diameter.

The bottom wall 4 is raised up inwardly to form a rise 4*a*, having a conical lower portion 4*b*, hereinafter the rise is referred to as a conical rise and the peripheral based portion 5 thereof is connected to an annular inner ground-contacting portion 20. Also, a slant 3*a* is formed between the lower part of the body portion 3 and said ground-contacting portion 20 at the lower end thereof. In the entire area of said slant 3*a* are formed a plurality of equidistantly spaced-apart outward bulges 6 which are each in the form of a longitudinally elongated hollow, with the underside of each said bulge 6 being formed flat to serve as an outer ground-contacting portion 7. Said outer ground-contacting portions 7 are arranged continuous to and radially around the inner ground-contacting portion 20, and they are located on a same plane to allow stable upright standing of the bottle 1.

The conical rise 4*a* is small in diameter at its lowermost portion so that it can well withstand internal pressure in the bottle. Since the basal portion 5 of said conical rise 4*a* is small in diameter, the inner ground-contacting portion 20 formed around said basal portion is also small in diameter, but as there are provided therearound a plurality of outward bulges 6 which form the outer ground-contacting portions 7, a large-diameter ground-contacting area is provided at the bottom of the bottle. Therefore, the standing position of this bottle is far more stabilized than the bottle which has no such outer ground-contacting portions.

The plurality of outward bulges 6 at the lower part of the bottle body portion and the conical rise 4*a* at the bottle bottom produce a rib-like function to provide the bottle with high strength. Also, the bottle properties are improved by the effect of biaxial orientation. If the bottle is molded from a saturated polyester resin, there is no seepage of harmful matter such as solvent in use, and also no noxious gas is produced when the discarded bottle is burned.

Figure 3:
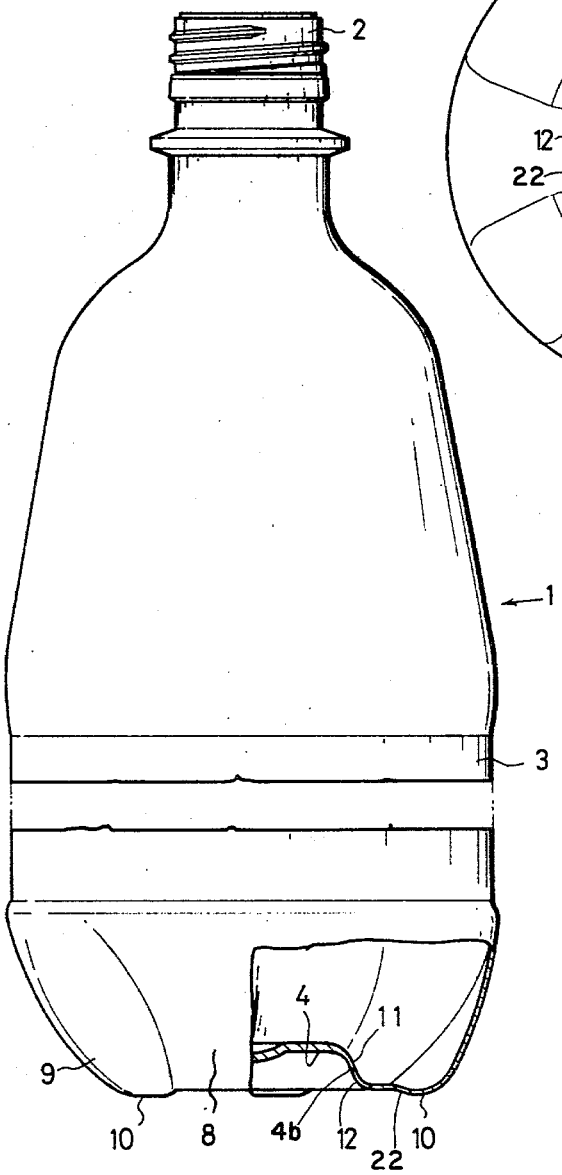
FIG. 3 is a sectional view, with parts broken away, of a synthetic resin thin-walled bottle in another embodiment of this invention.
Figure 4:
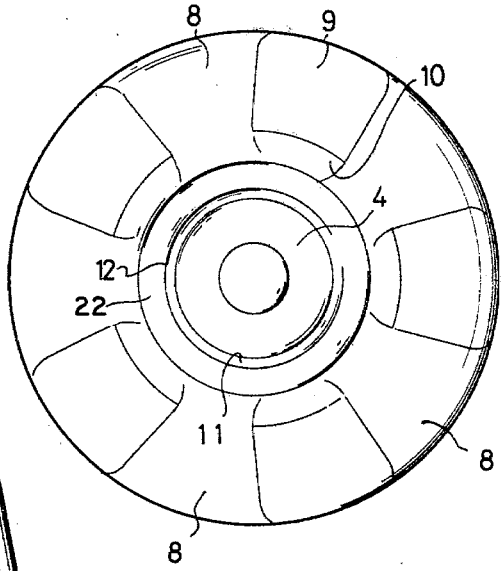
FIG. 4 is a bottom view thereof.

Referring now to FIGS. 3 and 4, there is shown a second embodiment of this invention. In this embodiment, the lower part of the bottle body portion 3 is curved inwardly downwards to form a curved section 8, and a plurality of longitudinally elongated outward bulges 9 are formed in said curved section 8, with the outer peripheral part of each said bulge 9, being projected slightly downwardly to form a ground-contacting surface 10. The bottom portion continuous to the lower end of said curved section 8 is inwardly raised up to form a conical rise 11, with the basal end 12 merging into the ground-contacting portion 10 positioned downwardly thereof through an annular interconnect portion 22.

Thus, the bottle of this second embodiment is formed with a conical rise 11 with a small diameter, so that the bottle bottom portion is provided with high endurance against internal pressure in the bottle and also said conical rise 11 is enhanced in rigidity. Although the rise 11 is thus small in diameter, the portion at which the bottle bottom contacts the ground when in its standing position is limited to the area 10 at the outer periphery alone of the bottle bottom, so that the standing position of the bottle when empty is stabilized. When the bottle is empty, the center of gravity thereof is positioned higher than that of the full bottle, so that if the inner peripheral area of the bottle bottom is designed to serve as ground-contacting surface, the bottle tends to fall down when even a small protuberance exists on the place where the bottle is to be rested in its standing position, but such tendency is minimized by allowing contact of only the outer peripheral portion of the bottle bottom with the place.

Although there are provided five bulges 9 at the lower part of the bottle body portion in the embodiment shown in FIG. 4, such bulges may be provided in any suitable number. It is also possible to form a reinforcing rib or ribs for each such bulge 9.

Figure 5:
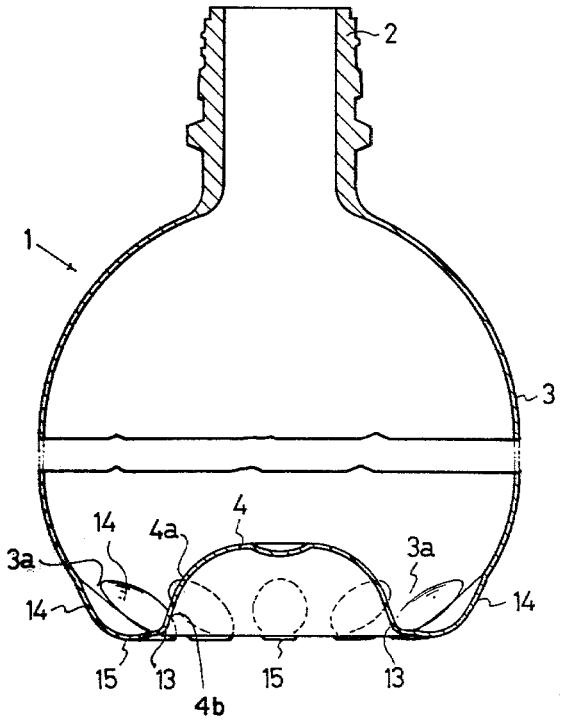
FIG. 5 is a sectional view, with parts broken away, of a synthetic resin thin-walled bottle in still another embodiment of this invention.
Figure 6:
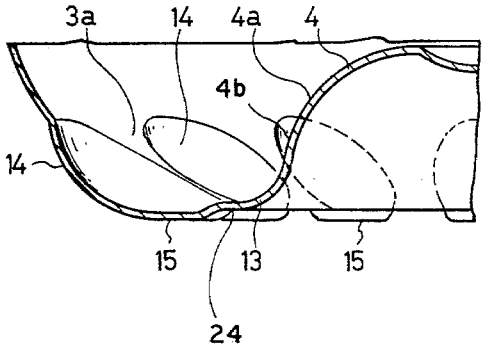
FIG. 6 is an enlarged sectional view thereof.

Reference is now had to FIGS. 5 and 6 which illustrate a third embodiment of this invention. This embodiment is designed to provide the bottle with even higher stability in its upright standing position when the bottle is empty. The bottom wall 4 of the thin-walled bottle 1 is raised up inwardly of the bottle and the basal end 13 thereof is connected to an annular flat strip 24. Also, a plurality of longitudinally elongated outward bulges 14 are formed in the slant section 3*a* at the lower part of the bottle body portion 3, with the underside of each said bulge 14 serving as an outer ground-contacting surface 15. The outer ground-contacting surface 15 is positioned slightly downwardly of said annular flat strip 24 with a stepped portion therebetween. Said annular flat strip 24 is positioned at a higher level than the outer ground-contacting surface 15 and is not brought into contact with the ground when the bottle is empty, but once the bottle is filled with a liquid, the strip 24 is pressed down by the liquid weight against its elasticity to the same position as that of the outer ground-contacting surface 15 and is thereby brought into contact with the ground.

Thus, in this embodiment, since the conical rise 4*a* is formed with a small diameter, a higher strength is provided against internal pressure than the bottle with a rise of a larger diameter, and also said rise 4*a* is enhanced in rigidity because of sufficient orientation. Further, although the conical rise 4*a* is small in diameter, the outer ground-contacting surface at which the bottom of the bottle when empty is brought into contact with the bottle resting place is positioned even more outwardly than in the preceding embodiments because of provision of the annular flat strip 24, so that the upright standing position of the empty bottle is even more stabilized.

When the bottle is filled with a liquid, the annular flat strip 24 is brought into contact with the bottle resting place by the liquid weight to form an annular inner ground-contacting surface, so that even when the bottle is placed upright on a shelf consisting of a plurality of spaced-apart crosspieces such as used in, a refrigerator, there is no possibility that the plurality of outward bulges 14 should get caught between the crosspieces, thus assuring convenience of use of the bottle.

What is claimed is:

1. A synthetic resin thin-walled bottle having a neck portion, a biaxially oriented body wall portion extending downwardly from the neck portion and a bottom wall portion connected to the lower extremity of said body wall portion through a body wall section which extends downwardly and inwardly to said bottom wall portion, the bottom wall portion of said bottle having an upwardly projecting rise having a conical lower portion and an annular basal portion connected to said section and said rise through a substantially planar annular interconnect area, said section having spaced on the circumferential periphery thereof a plurality of rounded bulges projecting outwardly from said section, each of said bulges having an underside surface positioned more outwardly than said annular interconnect area, the underside surface of said bulges being annularly arranged and forming an outer ground-contacting surface for said bottle.

2. A synthetic resin thin-walled bottle according to claim 1, wherein said interconnect area forms an inner ground-contacting surface on the inside of said outer ground-contacting surface.

3. A synthetic resin thin-walled bottle as in claim 1 wherein said section slants downwardly and inwardly to said bottom wall portion.

* * * * *